US005967863A

United States Patent [19]

Marchant

[11] Patent Number: 5,967,863

[45] Date of Patent: Oct. 19, 1999

[54] TROLLING MOTOR

[76] Inventor: Gary R. Marchant, P.O. Box 2771, Palestine, Tex. 75802

[21] Appl. No.: 09/078,562

[22] Filed: Apr. 15, 1998

[51] Int. Cl.[6] ..... B63H 1/15

[52] U.S. Cl. ..... 440/6; 181/206; 440/52

[58] Field of Search ..... 440/6, 7, 52, 75; 181/206

[56] References Cited

U.S. PATENT DOCUMENTS

| | | | |
|---|---|---|---|
| 1,021,408 | 3/1912 | Haschke | 440/6 |
| 2,585,774 | 2/1952 | Heidner et al. | 440/52 |
| 2,756,713 | 7/1956 | Kort | 115/42 |
| 2,848,884 | 8/1958 | Maude | 64/30 |
| 2,877,733 | 3/1959 | Harris | 115/18 |
| 3,013,518 | 12/1961 | Smith | 440/6 |
| 3,201,953 | 8/1965 | Firth | 64/30 |
| 3,315,631 | 4/1967 | Bass | 440/6 |
| 3,424,287 | 1/1969 | Dreiding | 192/55 |
| 3,587,512 | 6/1971 | Patterson | 115/18 |
| 3,606,858 | 9/1971 | Edwards et al. | 115/18 |
| 3,826,870 | 7/1974 | Wurm et al. | 179/1 P |
| 3,845,839 | 11/1974 | Eriksson | 181/33 |
| 3,954,082 | 5/1976 | Roller et al. | 115/18 |
| 4,293,304 | 10/1981 | Sandstrome t al. | 440/83 |
| 4,787,868 | 11/1988 | Hoshiba et al. | 440/52 |
| 5,169,349 | 12/1992 | Hilbert | 440/6 |
| 5,336,119 | 8/1994 | Lais et al. | 440/6 |
| 5,389,746 | 2/1995 | Moody | 181/0.5 |
| 5,597,245 | 1/1997 | Meyerhoff | 440/67 |

FOREIGN PATENT DOCUMENTS

| | | | |
|---|---|---|---|
| 24 49 595 A1 | 4/1976 | Germany | 440/6 |
| 63-246527 | 10/1988 | Japan . | |
| 850509 | 8/1981 | U.S.S.R. . | |
| 2 126 837 | 3/1984 | United Kingdom . | |
| 2 264 683 | 9/1993 | United Kingdom . | |

*Primary Examiner*—Sherman Basinger
*Attorney, Agent, or Firm*—Richard C. Litman

[57] ABSTRACT

The present invention is a trolling boat motor assembly that provides a motor displaced above the water line which is connected to a propeller shaft below the water line by one of a belt drive assembly, worm gear assembly, or flexible cable drive assembly. The motor is housed above the water line to limit the amount of noise transmitted through the water. There are noise insulating bushings placed beneath the motor to further limit the transmission of noise into the water and thus disturbing the marine life therein. There is a noise inversion device that transmits a signal 180 degrees out of phase from noise detected in the water, thereby reducing the amount of audible noise.

5 Claims, 5 Drawing Sheets

TROLLING MOTOR

BACKGROUND OF THE INVENTION

1. Field of the Invention

The present invention relates generally to trolling motors. More specifically, the invention is an improved trolling motor which utilizes a unique structural configuration as well as noise reducing means to render the device extremely quiet.

2. Description of the Related Art

It is common for boaters to desire extremely quiet boat motors for several reasons. One reason for desiring a quiet motor is to avoid disturbing the surrounding environment or disrupting one's enjoyment of a day on the water. Fishermen generally desire a quiet boat motor to prevent disrupting the underwater environment of the fish which would likely scare them away.

A typical trolling boat motor is designed to run quietly. Trolling boat motors are generally fashioned such that there is an electric motor provided within a housing and a shaft which is connected to the motor at one end and to a propeller at its other end. These motors, although relatively quiet, do create noise which may disturb the marine environment.

Boat motors, and boat motor noise reduction methods have been the subject of prior patents. U.S. Pat. No. 2,756,713 issued on Jul. 31, 1956 to Kort discloses a method of and a means for reducing noises and vibrations produced by screw propellers of ships. Kort accomplishes its objectives by forming uniquely shaped nozzles around the propellers or modifying the shape of the hull of the ship. Kort does not disclose reducing motor noise by means as described in the present invention.

U.S. Pat. No. 2,877,733 issued on Mar. 17, 1959 to Harris discloses an electric steering and power control system for outboard motors. Harris discloses a motor which is displaced below the water line.

U.S. Pat. No. 3,845,839 issued on Nov. 5, 1974 to Eriksson discloses a device for use in a motor boat for damping the noise directly or indirectly produced by a motor. The device has a noise damping receptacle in the shape of a box which slides into the hull of the boat. Eriksson does not disclose reducing motor noise by means as described in the present invention.

U.S. Pat. No. 3,587,512 issued on Jun. 28, 1971 to Patterson discloses a boat with secondary propulsion means. The boat has a motor and propeller assembly mounted within the bow of the boat that can be raised and lowered when needed. Patterson does not teach or describe any means of connecting the motor and propeller.

U.S. Pat. No. 3,606,858 issued on Sep. 21, 1971 to Edwards et al. discloses a remotely steerable electric outboard motor which is placed below the water line. Edwards et al. teaches away from the present invention where the motor is placed above the water line.

U.S. Pat. No. 3,954,082 issued on May 4, 1976 to Roller et al. discloses a housing and sealing gasket enclosing an unsealed DC motor for submerged use in water. The invention in Roller et al. teaches away from the present invention, where the object is to have the motor displaced above the water line.

U.S. Pat. No. 4,293,304 issued on Oct. 6, 1981 to Sandstrom et al. discloses a flexibly mounted drive shaft for a ship. The orientation of the shafts and the fact that they are prevented from vibrating a significant amount renders the motor and propeller motion relatively quiet. Sandstrom et al. does not disclose reducing motor noise by means as described in the present invention.

U.S. Pat. No. 4,787,868 issued on Nov. 29, 1988 to Hoshiba et al. discloses an outboard motor drive having an improved arrangement for absorbing torsional vibrations and isolating the drive shaft from the vibrations. The vibrations are absorbed in some embodiments by an elastomeric sleeve, and in other embodiments by a viscous fluid. The patent issued to Hoshiba et al. does not disclose a means for reducing motor noise as in the present invention.

U.S. Pat. No. 5,169,349 issued on Dec. 8, 1992 to Hilbert discloses an electric trolling motor apparatus provided with a passage that protects a wire of a sonar unit which is connected to the motor. Hilbert does not disclose the placement of the trolling motor above the water line in addition to noise isolating means as in the present invention.

U.S. Pat. No. 5,336,119 issued on Aug. 9, 1964 to Lais et al. discloses a drive unit for relatively small water craft having a cylindrical underwater partial housing which carries, at one end, an electric motor, with which a propeller is arranged, at the other end, in such a way that it is seated on a shaft which is rotatably mounted in a parallel relationship with the motor output shaft. The motor output shaft and the propeller shaft are connected by a toothed belt drive. Lais does not disclose reducing motor noise by means as described in the present invention.

U.S. Pat. No. 5,389,746 issued on Feb. 14, 1995 to Moody discloses an acoustic isolation structure in the hull of a submarine to reduce noise generated by the submarine. Moody does not teach motor noise reduction methods as described in the present invention.

U.S. Pat. No. 5,597,245 issued on Jan. 28, 1997 to Meyerhoff discloses a propeller cavitation suppression system. The invention relates to a device for use with a ducted propeller system for suppressing gap cavitation between a moving rotor tip and a duct wall. Meyerhoff does not disclose motor noise reduction methods as in the present invention.

UK Patent No. 2,264,683 published on Sep. 8, 1993 discloses a vibration absorbing steering device for outboard motors. The device is designed to reduce vibrations that are typically transmitted to the drive shaft, the propeller, and the operator of the motor. The invention does not disclose noise reduction means as disclosed in the present invention.

Japanese Patent No. 63-246,257 Published on Oct. 13, 1988 discloses a method of reducing vibration energy effectively over a wide band of vibration by analyzing a detected vibration spectrum and vibration mode such as phase, then outputing vibration suppressing energy having phase shifted by 180 degrees corresponding to the magnitude of the respective vibrations.

Other patents which are generally related to the present invention are U.S. Pat. No. 2,848,884 (Gear) issued on Aug. 26, 1958 to Maude; U.S. Pat. No. 3,201,953 (Torque Limiting Device) issued on Aug. 24, 1965 to Firth; U.S. Pat. No. 3,424,287 (Yieldable Clutch) issued on Jan. 28, 1969 to Dreiding; and Russian Patent No. 850,509 published in August 1981.

None of the above inventions and patents, taken either singularly or in combination, is seen to describe the instant invention as claimed. Thus an improved trolling motor solving the aforementioned problems is desired.

SUMMARY OF THE INVENTION

The present invention is a trolling boat motor assembly that provides a motor displaced above the water line which is connected to a propeller shaft below the water line by a connecting means. The motor is housed above the water line to limit the amount of noise transmitted through the water. There are noise insulating bushings placed beneath the motor to further limit the transmission of noise into the water and thus disturbing the marine life therein. There is a noise inversion device that transmits a signal 180 degrees out of phase from noise detected in the water, thereby reducing the amount of audible noise.

Accordingly, it is a principal object of the invention to provide an improved trolling motor that is rendered extremely quiet.

It is another object of the invention to provide an improved trolling motor assembly that places the motor above the water line to prevent the motor noise from being transmitted through the water.

It is a further object of the invention to provide an improved trolling motor assembly that utilizes noise inversion techniques to prevent large amounts of audible noise from being transmitted in the water.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
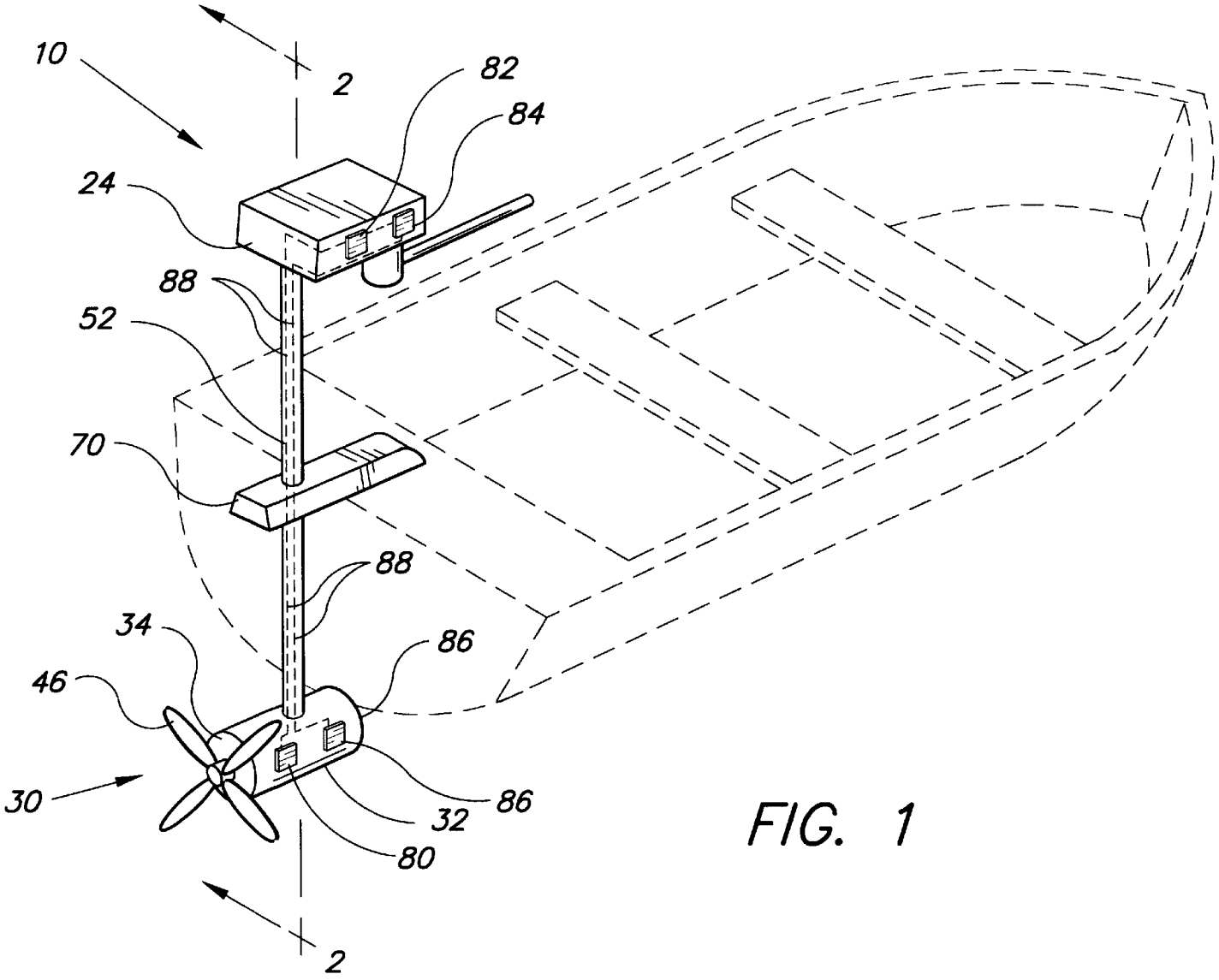
FIG. 1 is an environmental, perspective view of an improved trolling motor according to the present invention.

The present invention is an improved trolling motor assembly 10 which comprises a motor 20 displaced above the water line, a propeller assembly 30, a connecting means 50 for connecting the motor 20 and propeller assembly 30, noise isolating bushings 58, noise inversion means, and a support bracket 70.

The motor 20 is displaced above the water line to prevent the noise from the motor from disturbing the surrounding marine environment. For trolling purposes, the ideal motor is an electric motor known to those skilled in the art for that purpose. The motors 20 are generally low power and somewhat quiet. Since the motor 20 does not require any cooling during operation, there is no need to have it submerged. The motor 20 is enclosed within a motor housing 24 to prevent it from getting wet during operations. The motor housing 24 is provided with bore 26 through one end.

The connecting means 50 is enclosed by a connector housing 52 having a first end 54 and a second end 56 which provides stability for the connecting means 50 as well as protection for the wires 88 which will be described herein below. Further, there are noise isolating bushings 58 within the connector housing 52 near the first end 54 to provide further insulation of motor noise from the marine environment. The first end 54 of the connector housing 52 is coupled with the bore 26 in the motor housing 24 and the second end 56 of the connector housing 52 is coupled with the propeller assembly 30 as will be described below.

Projecting from the motor 20 is a drive shaft 22 which couples with the connecting means 50. The opposite end of the connecting means 50 is coupled with the propeller assembly 30. The propeller assembly 30 comprises a propeller housing 32 having a first end 34 and a second end 36, a propeller shaft 40 having a first end 42 and a second end 44, and a propeller 46. The propeller housing 32 defines a bore 38 near its second end 44 which is coupled with the connector housing 52 at its second end 56. The second end 44 of the propeller shaft 40 is coupled with the connecting means 50 and with the propeller 46. The rotation of the motor 20 causes the rotation of the connecting means 50, which in turn causes the rotation of the propeller 46.

Figure 2:
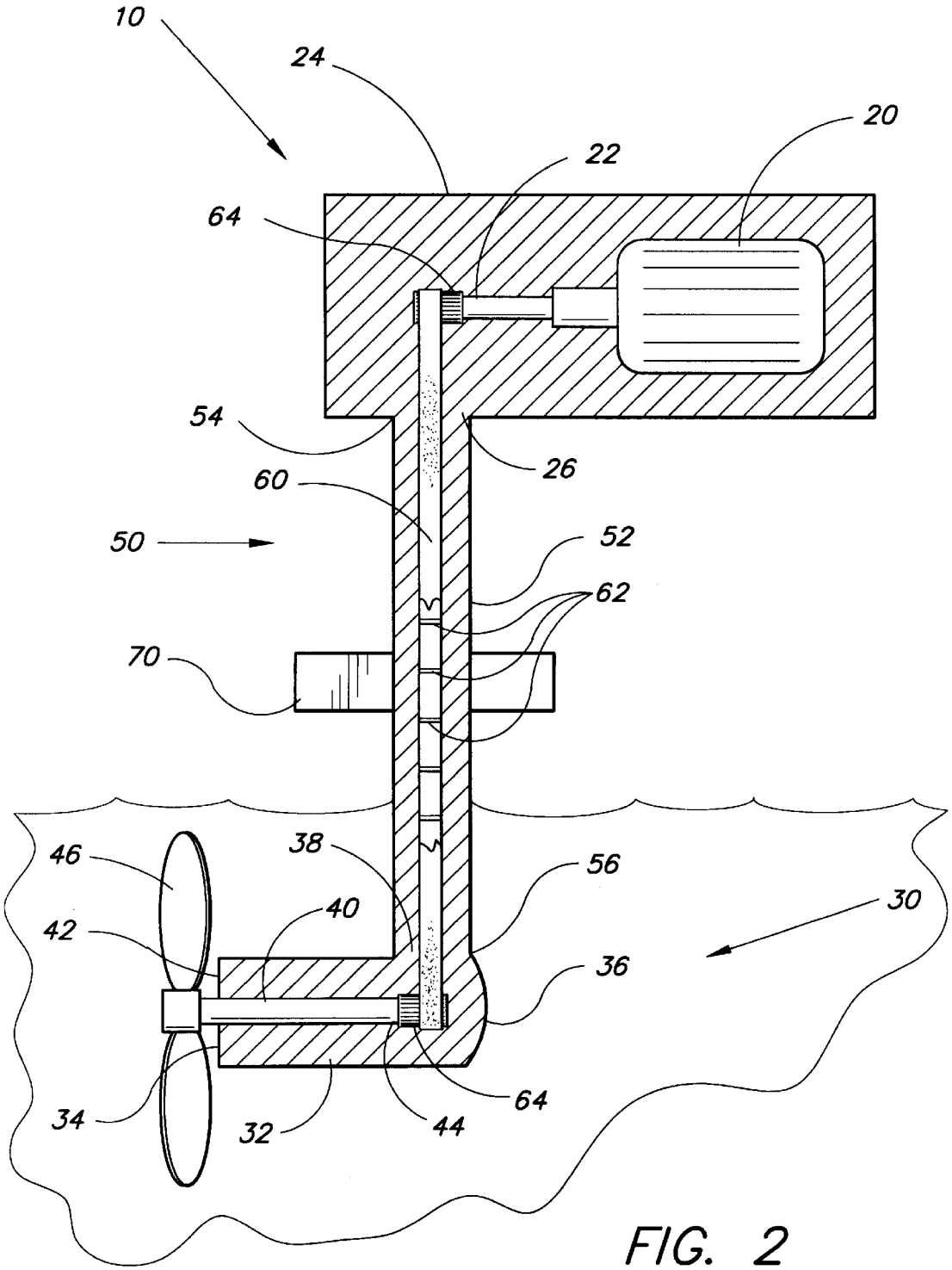
FIG. 2 is a side cross section of an improved trolling motor according to the present invention utilizing a belt drive.

The connecting means 50 can be a typical belt drive, a worm gear assembly, or a flexible cable assembly. In the embodiment where the connecting means is a belt drive (FIG. 2), the motor 20 is oriented such that the drive shaft 22 is parallel to the propeller shaft 40. The drive shaft 22 is provided with a gear 64 for engaging the teeth 62 in the belt 60 such that the belt 60 will rotate without slipping. The second end 44 of the propeller shaft 40 is likewise provided with a similar gear 64 for engaging the belt 60.

Figure 3:
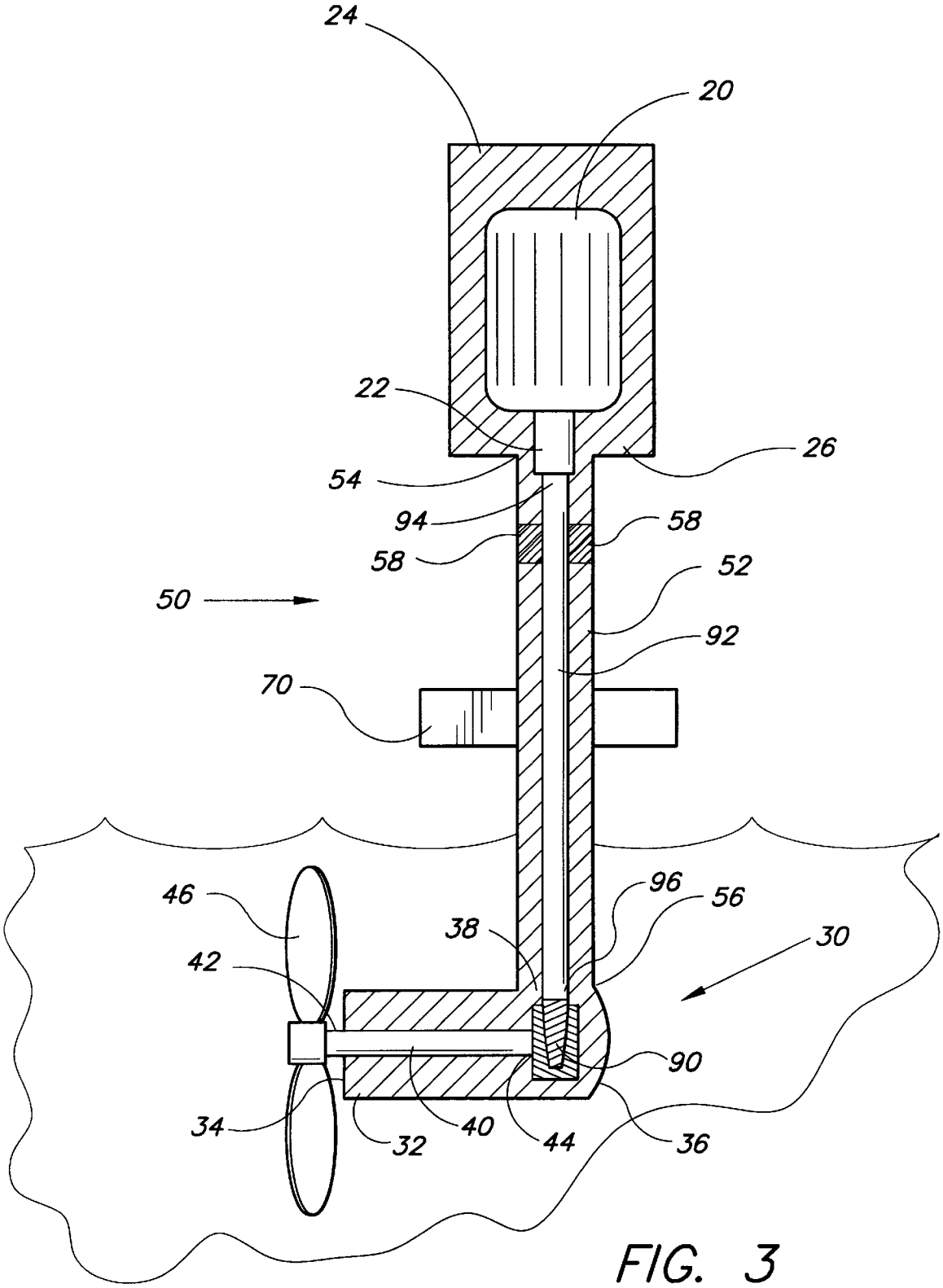
FIG. 3 is a side cross section of an improved trolling motor according to the present invention utilizing a worm gear assembly.
Figure 4:
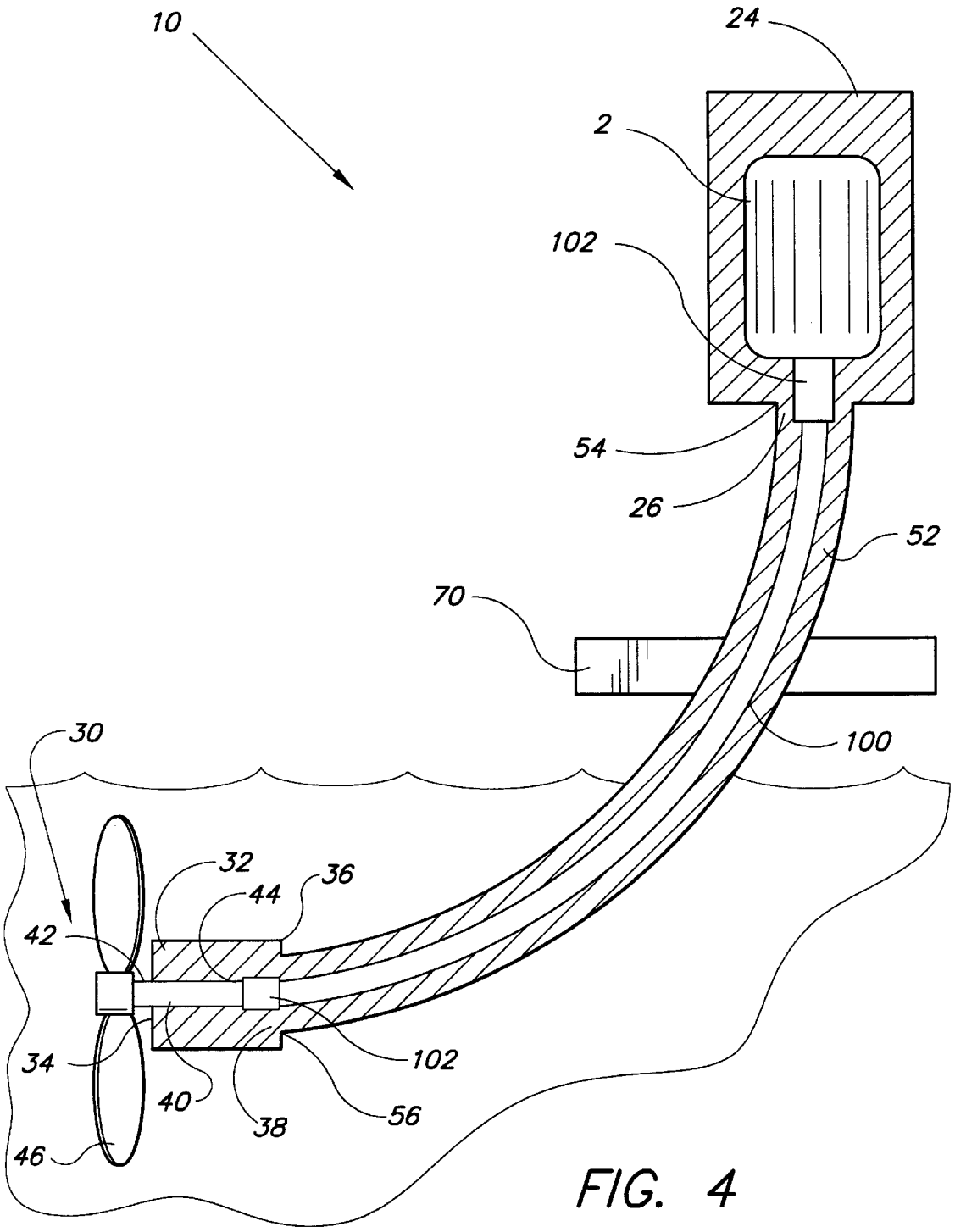
FIG. 4 is a side cross section of an improved trolling motor according to the present invention utilizing a cable drive assembly.
Figure 5:
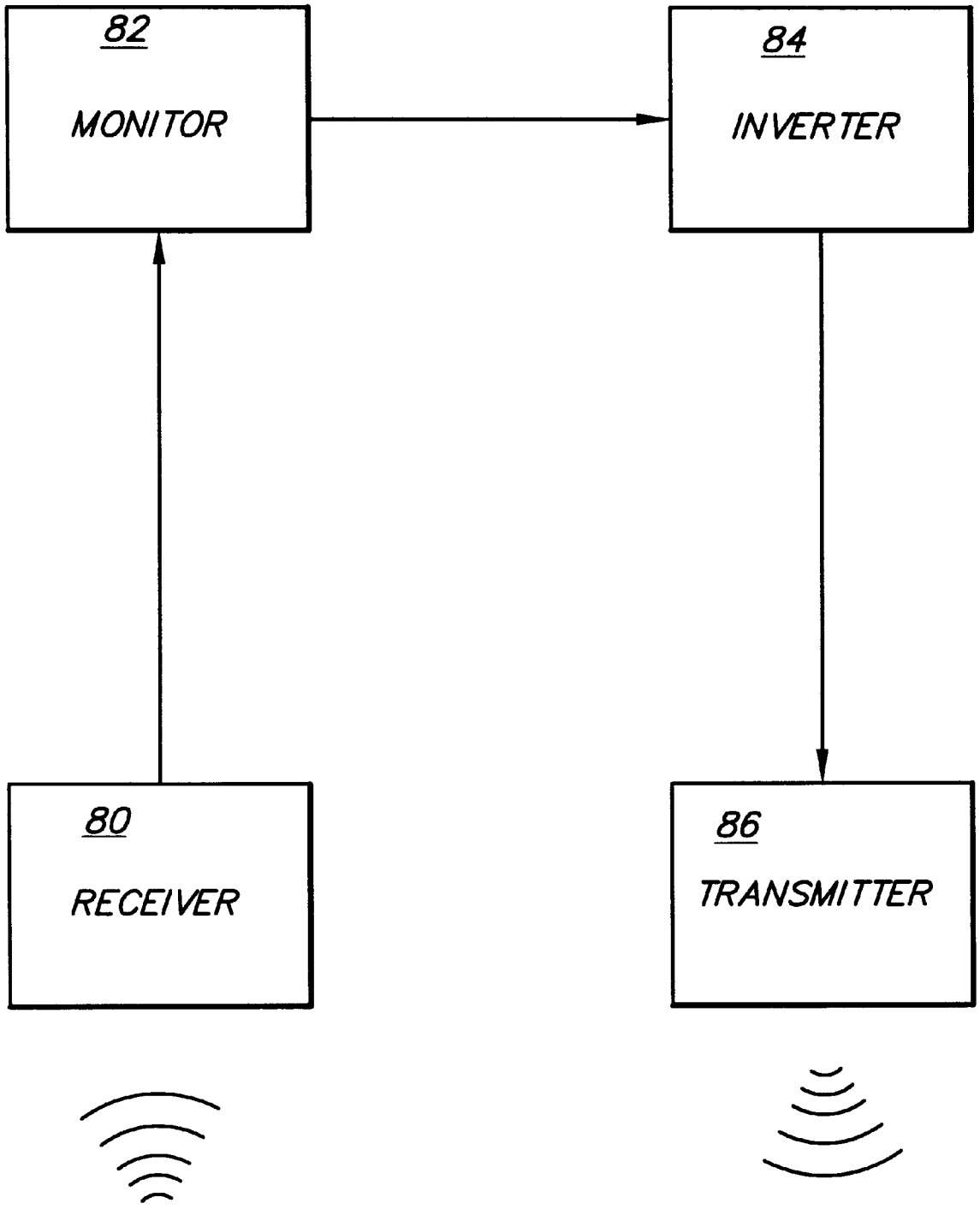
FIG. 5 is a schematic of the noise inversion device according to the present invention.

When the connecting means 50 is either a worm gear assembly or a flexible cable assembly (FIGS. 3 & 4), it is preferred for the motor 20 to be oriented such that the drive shaft 22 is perpendicular to the propeller shaft 40 to reduce the need for expensive gearing.

In the embodiment where the connecting means 50 is a worm gear assembly (FIG. 3), there is an extension rod 92 having a first end 94 and a second end 96. The first end 94 of the extension rod 92 is integrally formed with the drive shaft 22 and the second end 96 is provided with a worm gear configuration 90 thereon. The propeller shaft 40 is provided with a worm gear configuration 90 on its second end 44 for engaging the extension rod 92.

In the embodiment where the connecting means 50 is a cable drive assembly (FIG. 4), there are couplings 102 attached to the drive shaft 22 and the propeller shaft 40. There is a flexible cable 100 integrally formed with the couplings 102. Additionally, in this embodiment, the connector housing 52 is arcuate in shape.

In order to further limit the introduction of ambient noise into the water, a noise inversion means is provided. The noise inversion means comprises a receiver 80, a monitor 82, a signal inverter 84, and a transducer 86. The receiver 80, which is attached to the propeller housing 32, picks up any noise signal in the surrounding environment. Alternatively, the receiver 80 may be mounted on motor housing 24. The signal is then transmitted to a monitor 82, which then transmits the signal to an inverter 84 which inverts the signal and transmits the inverted signal to the transducer 86 which is attached to the propeller housing 32. The transducer 86 transmits a signal approximately 180 degrees out of phase from the original signal to destructively interfere with the ambient noise, thereby creating an overall quieter environment in the water. As stated above, the wires 88 that connect the elements of the noise inversion means are housed within the connector housing 52, propeller housing 32, and motor housing 24.

There is a support bracket 70 provided for securing the entire trolling motor assembly 10 to the stern of a boat, or elsewhere as is well known in the art. The type of support bracket 70 required is well known to those skilled in the art of trolling boat motors.

It is to be understood that the present invention is not limited to the embodiments described above, but encompasses any and all embodiments within the scope of the following claims.

I claim:

1. An improved trolling motor assembly comprising:

a motor housing defining a cavity therein, and defining a bore at one end;

an electric motor displaced within said motor housing, said motor being provided with a rotatable drive shaft at one end;

a connector housing having a first end and a second end, said first end coupled with said bore in said motor housing;

noise insulating bushings provided near said first end of said connector housing;

a connecting means having a first and second end;

a propeller assembly having a propeller housing having a first and second end and defining a bore in said second end; a propeller shaft having a first and second end; and a propeller;

said bore being coupled with said second end of said connector housing;

said second end of said propeller shaft being coupled with said second end of said connecting means;

said first end of said propeller shaft being integrally formed with said propeller;

noise inversion means; and a support bracket.

2. The improved trolling motor assembly according to claim 1, wherein said motor housing and said rotatable drive shaft are parallel with said propeller shaft, and said connecting means is a belt drive assembly comprising:

a flexible belt having an inner surface provided with teeth thereon;

a first gear integrally formed with said rotatable drive shaft;

a second gear integrally formed with said propeller shaft, wherein said belt is friction fit around said gears such that rotation of said rotatable drive shaft translates to said propeller shaft.

3. The improved trolling motor assembly according to claim 1, wherein said motor housing and said rotatable drive shaft are perpendicular to said propeller shaft, and said connecting means is a worm gear assembly comprising:

an extension rod having a first and second end, said first end integrally formed with said rotatable drive shaft;

said extension rod provided with worm gear construction at its second end;

said propeller shaft provided with a worm gear at its second end for engaging said worm gear construction of said extension rod.

4. The improved trolling motor assembly according to claim 1, wherein said motor housing and said rotatable drive shaft are perpendicular to said propeller shaft;

said connector housing is arcuate; and said connecting means is a flexible cable drive assembly comprising:

a first coupling integrally formed with said rotatable drive shaft;

a second coupling integrally formed with said propeller shaft; and a flexible cable integrally formed with said first and second couplings.

5. The assembly according to claim 1, wherein said noise inversion means is a circuit comprising:

a receiver attached to one of said motor housing and said propeller housing;

a monitor attached to said motor housing;

an inverter attached to said motor housing;

a transducer attached to said propeller housing, whereby a signal is received by said receiver and transmitted through said monitor to said inverter;

said inverted signal is then transmitted to said transducer and transmitted into the water.

* * * * *